US007938555B1

(12) United States Patent
Kalhofer

(10) Patent No.: US 7,938,555 B1
(45) Date of Patent: May 10, 2011

(54) EMERGENCY PREPAREDNESS LAMP

(76) Inventor: Richard Kalhofer, North Kingstown, RI (US)

( * ) Notice: Subject to any disclaimer, the term of this patent is extended or adjusted under 35 U.S.C. 154(b) by 448 days.

(21) Appl. No.: 11/969,980

(22) Filed: Jan. 7, 2008

(51) Int. Cl.
*F21V 33/00* (2006.01)

(52) U.S. Cl. ..... 362/183; 362/431; 307/66

(58) Field of Classification Search ..... 362/183, 362/431; 307/66
See application file for complete search history.

(56) References Cited

U.S. PATENT DOCUMENTS

| | | | | |
|---|---|---|---|---|
| 3,976,986 | A | 8/1976 | Zabroski | |
| 4,214,185 | A | 7/1980 | Breeze | |
| 4,255,746 | A * | 3/1981 | Johnson et al. | 340/577 |
| 4,590,543 | A | 5/1986 | Chen | |
| 4,611,264 | A | 9/1986 | Bradley | |
| 4,985,661 | A | 1/1991 | Lin | |
| 5,336,977 | A | 8/1994 | Li | |
| 5,620,247 | A * | 4/1997 | Swanson | 362/249.08 |
| 5,713,655 | A | 2/1998 | Blackman | |
| 5,806,961 | A | 9/1998 | Dalton et al. | |
| 6,000,807 | A | 12/1999 | Moreland | |
| 6,010,228 | A | 1/2000 | Blackman et al. | |
| RE36,696 | E | 5/2000 | Blackman | |
| 6,454,428 | B1 * | 9/2002 | Bruzon | 362/119 |
| 2004/0207534 | A1 | 10/2004 | Bolta | |
| 2007/0153494 | A1 | 7/2007 | Huang | |

OTHER PUBLICATIONS

Novelty/Accent Lighting—Emergency Flashlight (75128) http://www.lampsplus.com/Products/s Uplights!Cliplights/75128.

Amazon.com: Intermatic Three-Way Emergency Power Failure Light #PR3C http://www.amazon.com/Intermatic-Three-Way-Emergency-Failure-PR3C/dp/B00004W4XE.

* cited by examiner

*Primary Examiner* — Laura Tso

(74) *Attorney, Agent, or Firm* — David W. Denenberg; Davidoff Malito & Hutcher LLP

(57) ABSTRACT

In the event of a power outage, a lamp with rechargeable batteries automatically illuminates. The lamp may be a detachable flashlight that is mechanically and electrically connected to a pole lamp or a desk lamp, for instance, so that its batteries recharge when power is available for the pole lamp or desk lamp. A mechanical connection between the flashlight and the pole or desk lamp may be with threaded male and female connectors. An arm extension may be provided from the lamp to contain one of the mechanical connectors and one of the electrical connectors.

19 Claims, 11 Drawing Sheets

EMERGENCY PREPAREDNESS LAMP

BACKGROUND OF THE INVENTION

1. Field of the Invention

The present invention relates to an emergency preparedness lamp that has a connection between a rechargeable flashlight and a decorative lamp or lamp base that enables the flashlight to turn on automatically in the event of a power failure to the lamp and permit the flashlight to be removed from connection with the lamp base for independent use.

2. Discussion of Related Art

The concept of an emergency preparedness lamp that allows a rechargeable battery flashlight to light automatically during power outage to a lamp yet permitting its removal from the lamp to be used independently is known from many patents, such as U.S. Pat. Nos. 3,976,986; 4,590,543; 4,611,264; 4,85,661; 5,336,977; 5,645,341; 5,806,961; Re 36,696.

It would be desirable, however, to provide for such an emergency preparedness lamp that permits batteries of the same flashlight to be recharged through connection with any of a number of different styles of lamps while power is available yet go on automatically in the event of a power failure to the lamp. It would be further desirable to allow the flashlight to be easily removed from the lamp for independent use.

SUMMARY OF THE INVENTION

One aspect of the present invention relates to circuitry arranged to provide power from an external power supply to power a light source and to recharge rechargeable batteries to a substantially fully charged state. The circuitry is configured to sense a power outage of the external power supply and to power the light source with the rechargeable batteries in response to sensing the power outage. The circuitry including transistors, resistors and diodes, the light source including light emitting diodes and a reflector positioned to reflect back light striking the reflector from the light emitting diodes in a direction away from the reflector. A housing contains the circuitry and has a base and elevates the light source above the base as the base is stationary on an external surface. An indicator is powered by the circuitry to make an indication upon commencement of the recharge of the batteries by the power, the indication being selected from a group consisting of illumination and sound.

Another aspect resides in a connection between a flashlight and a lamp that is configured to mechanically connect them together yet permit their removal from each other and to electrically connect them together to enable recharging of batteries of the flashlight from a power supply to the lamp. Preferably, a threaded male/female connection is employed to enable the mechanical connection and an indicator is provided that activates in response to the electrical connection becoming established. The indicator may be visual, such as a light going on to signify charging, or audible, such as a clicking sound being heard to signify that the electrical connection is established.

BRIEF DESCRIPTION OF THE DRAWING

For a better understanding of the present invention, reference is made to the following description and accompanying drawing, while the scope of the invention is set forth in the appended claims.

DETAILED DESCRIPTION OF THE PREFERRED EMBODIMENT

Figure 1:
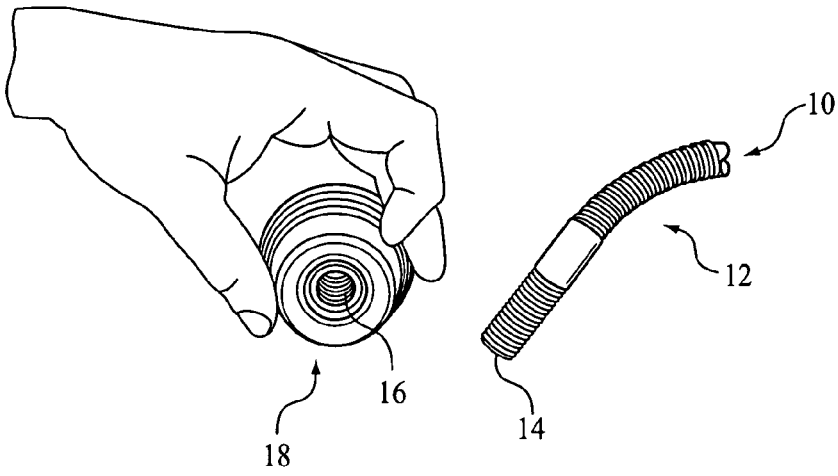
FIG. 1 is an isometric view of a rear of a detachable flashlight in accordance with the invention with a female threaded connector and a lamp arm extension with a threaded male connector in accordance with the invention.
Figure 2:
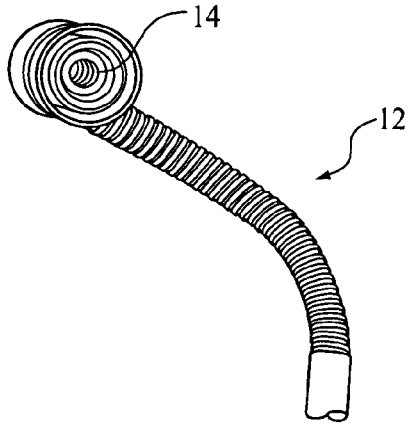
FIG. 2 is an isometric head on view of the connecting end of the male connector from the arm extension of the lamp.
Figure 3:
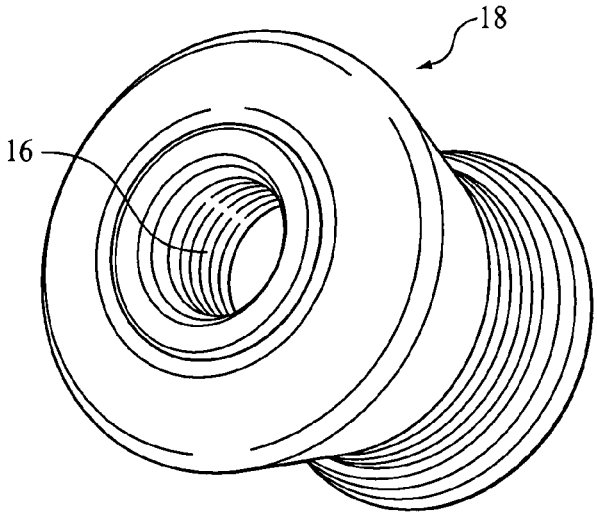
FIG. 3 is an isometric view of an underside of the flashlight of FIG. 1.
Figure 4:
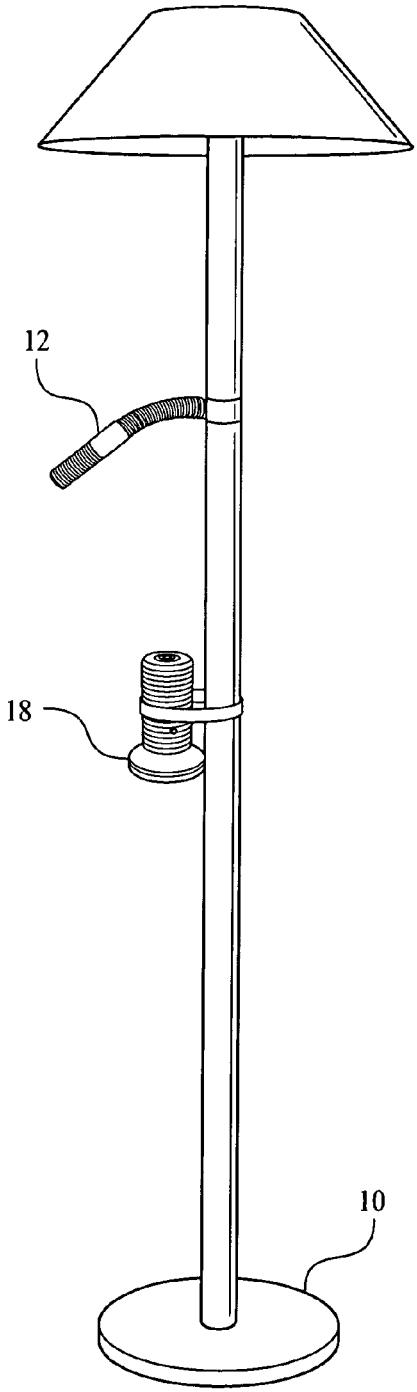
FIG. 4 is an elevation view of a pole lamp in accordance with the invention.
Figure 5:
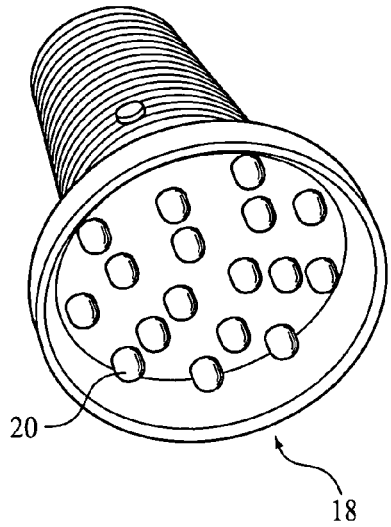
FIG. 5 is an isometric view of the topside of the flashlight of FIG. 3.
Figure 6:
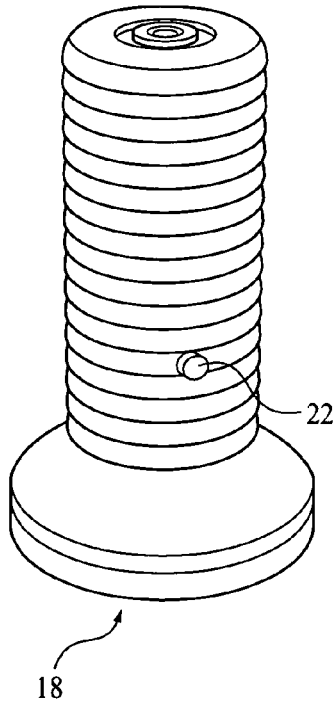
FIG. 6 is an isometric view of a side view of the flashlight of FIG. 4.

Turning to the drawings, FIGS. 1-6 show a lamp 10 that has an arm extension 12 connected to a detachable flashlight 18 by mechanical connectors. The mechanical connectors may be a threaded male connector 14 to which is screwed a threaded female connector 16. The mechanical connectors may be magnetic, dovetail, male/female, spring biased, plug/socket, or any other type known in the art. The flashlight 18 is powered by rechargeable batteries to power a light source, which is exemplified by LEDs 20 or any other type of conventional light bulb. The flashlight has a switch 22 to control the light going on and off.

The arm extension 12 may be flexible to retain its relative position with respect to the rest of the lamp in any one of a plurality of different positions.

Figure 7:
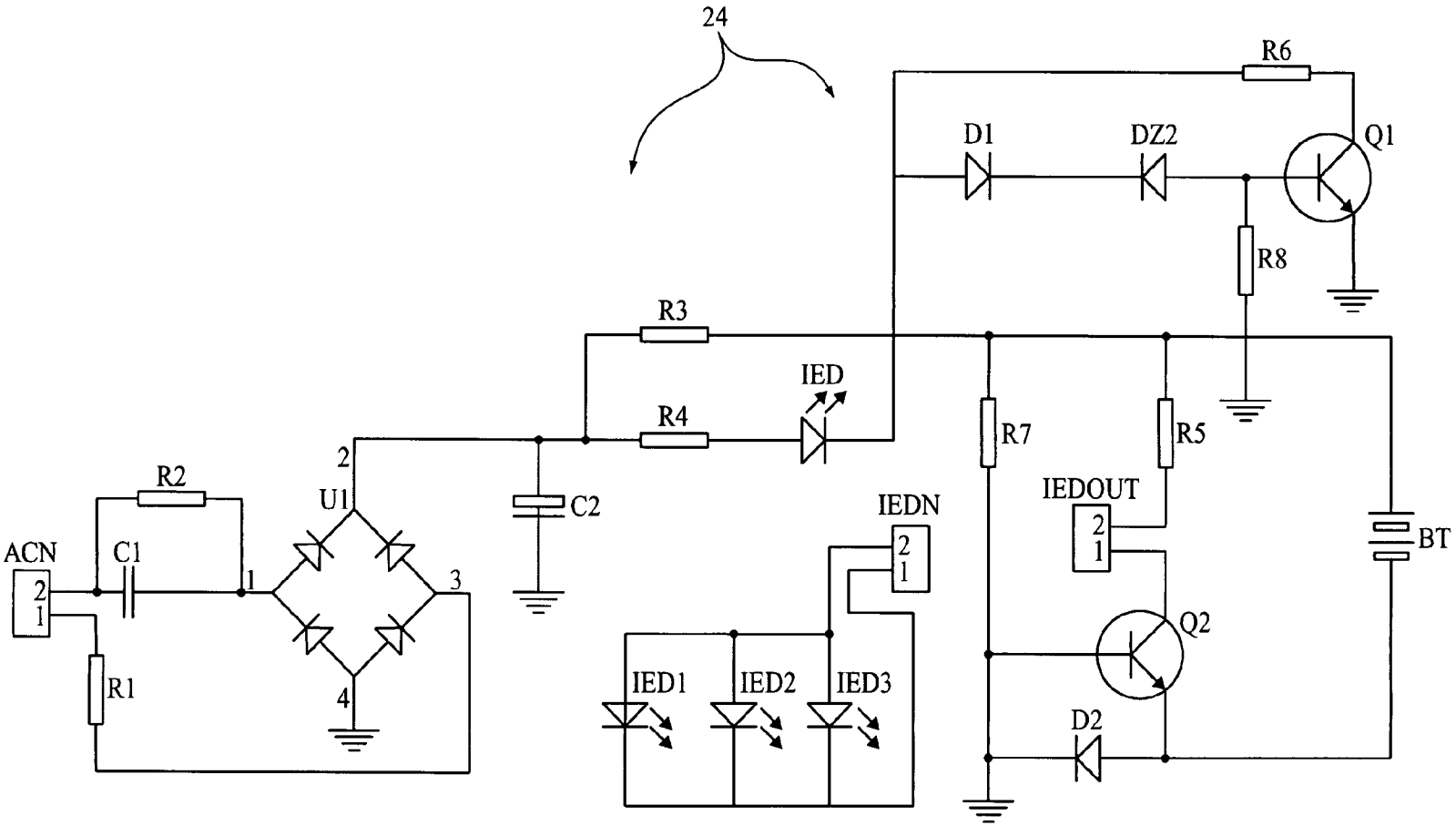
FIG. 7 is a wiring diagram for the emergency preparedness lamp of the invention.
Figure 8:
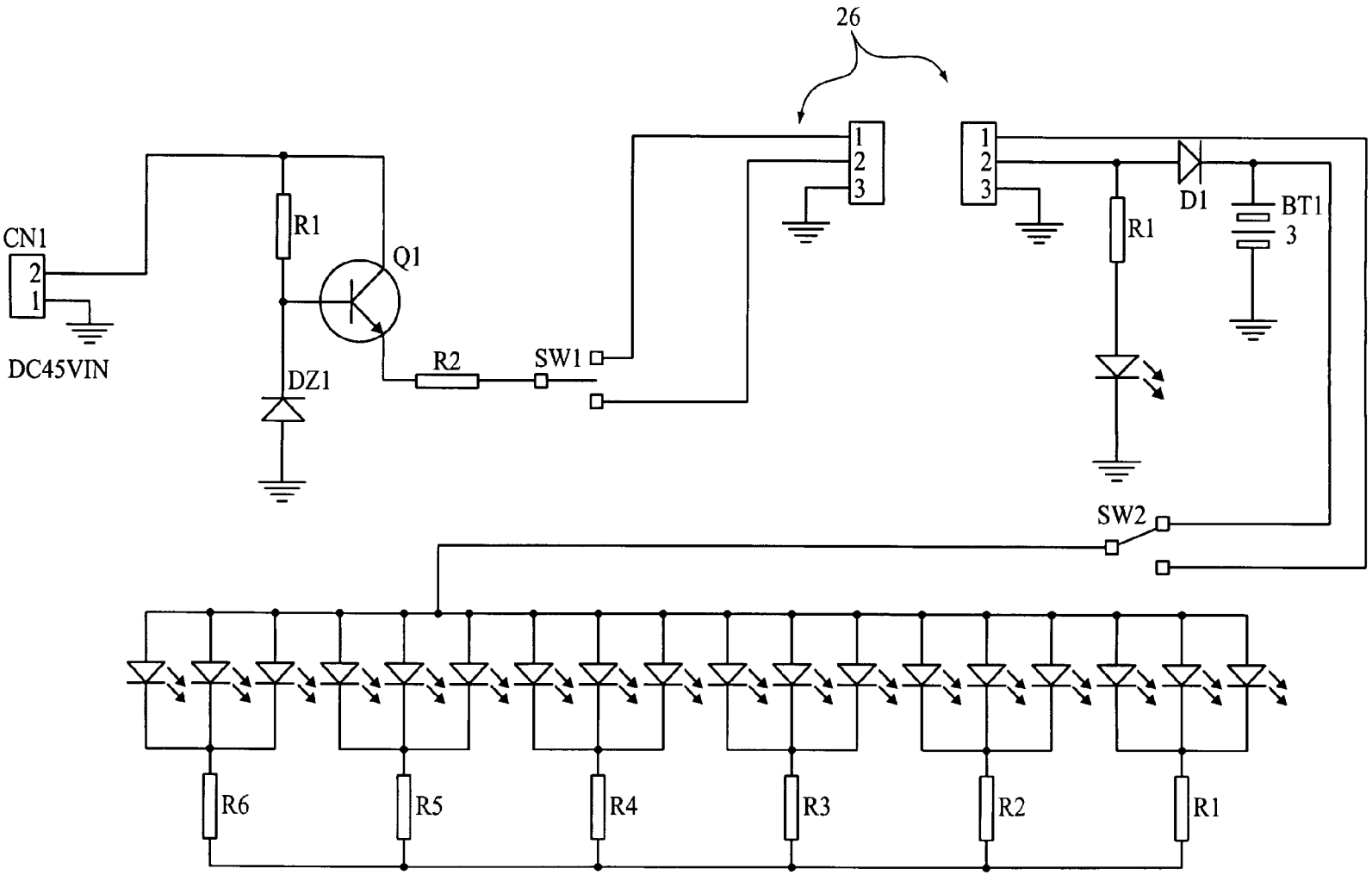
FIG. 8 is a wiring diagram for the flashlight of the invention.

FIGS. 7 and 8 show circuitry 24, 26 for controlling operation of the lamp 10 and the flashlight 18 so that the rechargeable batteries for the flashlight 18 recharge as needed as electrical contacts within the female connector 16 make electrical contact with complementary contacts with the male connector 14. For example, electrical pins may engage electrical socket holes when the male and female connectors and fully threaded with each other to provide the necessary electrical contacts between the flashlight 18 and the lamp arm extension 12. The electrical pins may be within the male connector 14 while the electrical sockets may be within the female connector 16.

Thus, while screwing the male and female connectors 14, 16, respectively, together by engaging their respective threads with each other, eventually a position is reached as they become increasingly engaged that causes electrical connection to be made between the flashlight and the lamp. If the rechargeable batteries of the flashlight 18 are not fully charged, then charging takes place from the same power source that is powering the lamp 10.

FIGS. 7 and 8 also show circuitry 24, 26 is configured so that in the event of a power outage, the flashlight 18 will illuminate automatically in response to such a power outage condition, which is detected by the circuitry to trigger activation of the flashlight 18 to illuminate automatically.

In addition, an indicator 49 (FIG. 10) activates when battery charging is taking place. The indicator may be an LED light source, as a visual indicator when illuminated, or may be a clicking sound heard when a certain relative position is reached when screwing the male and female connectors together that correspond to the relative position at which electrical connection is effected. Indeed, the clicking sound may come from electrical contacts engaging each other as the relative position is reached.

The female connector 16 of the flashlight 18 is compatible with the male connector 14 of any one of a number of different lamp styles of FIGS. 9-22, for instance. That is, the same flashlight may have its batteries recharged by connecting to any of the male connectors 14 of the different lamp styles and would go on automatically if attached when a power outage in the lamp is detected.

Figure 21:
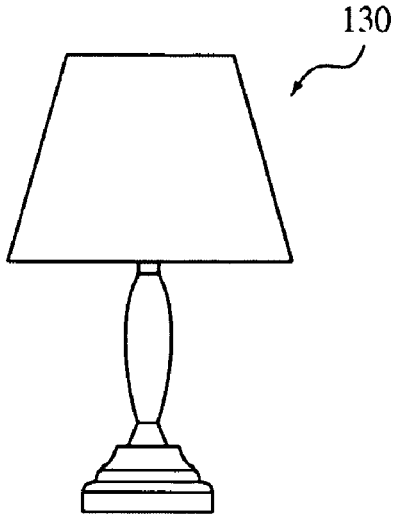
Figure 22:
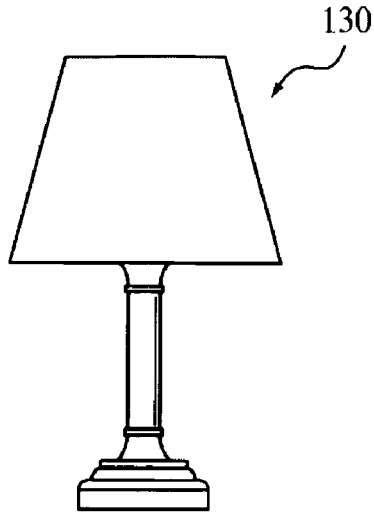

The lamp 10 may take the form of any one of a plurality of different lamp styles, such as a floor or pole lamp 30, 60, 100 (FIGS. 9-12, 16), a desk lamp 70, 80, 90 (FIGS. 13, 14, 15), a lantern 110 (FIGS. 17-20) or a table lamp 130 (FIGS. 21, 22). The lamp style may provide for the flashlight as well as a separate light bulb that illuminates during times when power is available to be supplied to the lamp. The lamp style may be configured to use the flashlight itself as its sole light source.

The removable light source also operates with normal electrical flow. The flashlight portion can operate along with the main light source as additional lighting as it pertains to floor lamps and is also the main source of the light as it pertains to the table lamps (see FIGS. 12, 13, 14 and 15).

If desired, the flashlight 18 may have the male connector 14 instead of the female connector 16 and the arm extension 12 may have the female connector 16 instead of the male connector 14. However, each of the flashlight and the arm extension has a respective one of the mechanical connectors and a respective one of the electrical connectors. Both the mechanical and electrical connectors engage with their compatible counterparts. The mechanical connectors may be of any conventional type, such as male/female, magnetic, dovetail, screw-threaded, quick release, etc.

Figure 11:
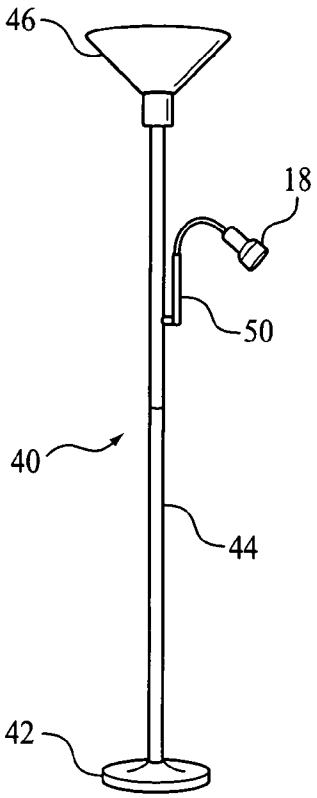
Figure 10:
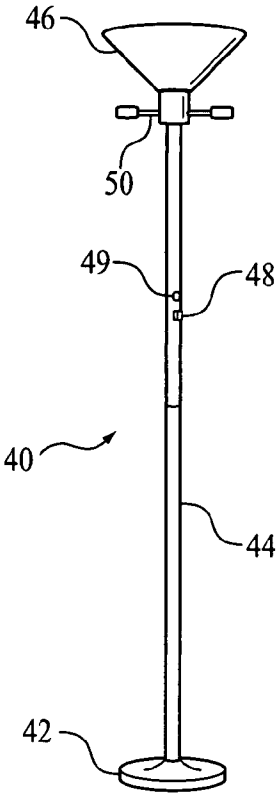
Figure 9:
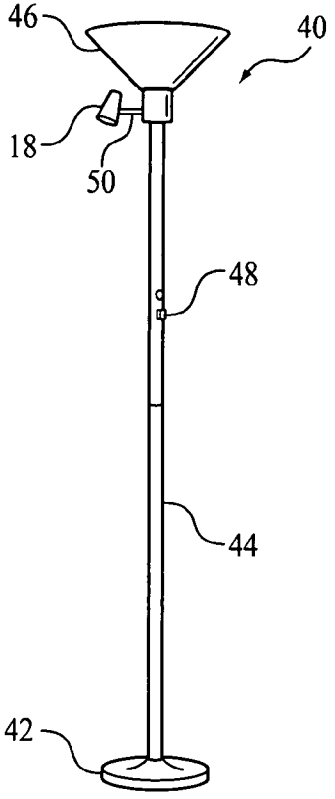

FIGS. 9-11 show pole floor lamps 40 each with a base 42, upstanding telescoping pole 44, a translucent lamp shade 46 shading a light source (hidden by the shade) and light switch 48. One or more extension arms 50 protrude outwardly from the pole 44 to provide a support to hold a flashlight 18, which in turn has rechargeable batteries that are powered by electrical circuitry of the lamp as in FIGS. 7 and 8. Although best seen in FIG. 10, an indicator light 49 is provided for each of the embodiments of FIGS. 9-11 to illuminate upon commencement of battery recharging.

Figure 12:
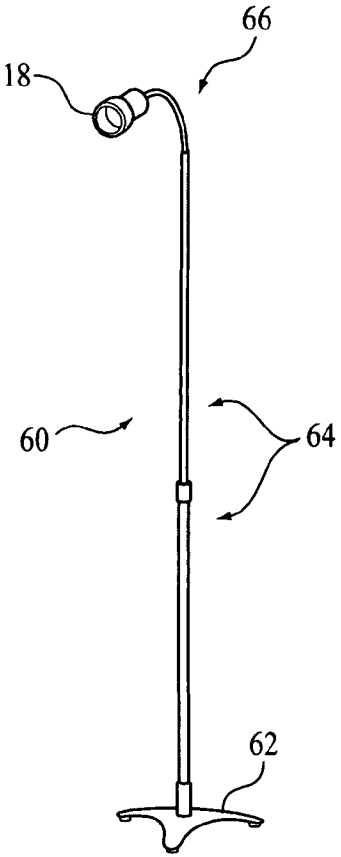
FIGS. 9-15 are isometric views of different styles of lamps in accordance with the invention that may accommodate attachment with the flashlight.
Figure 13:
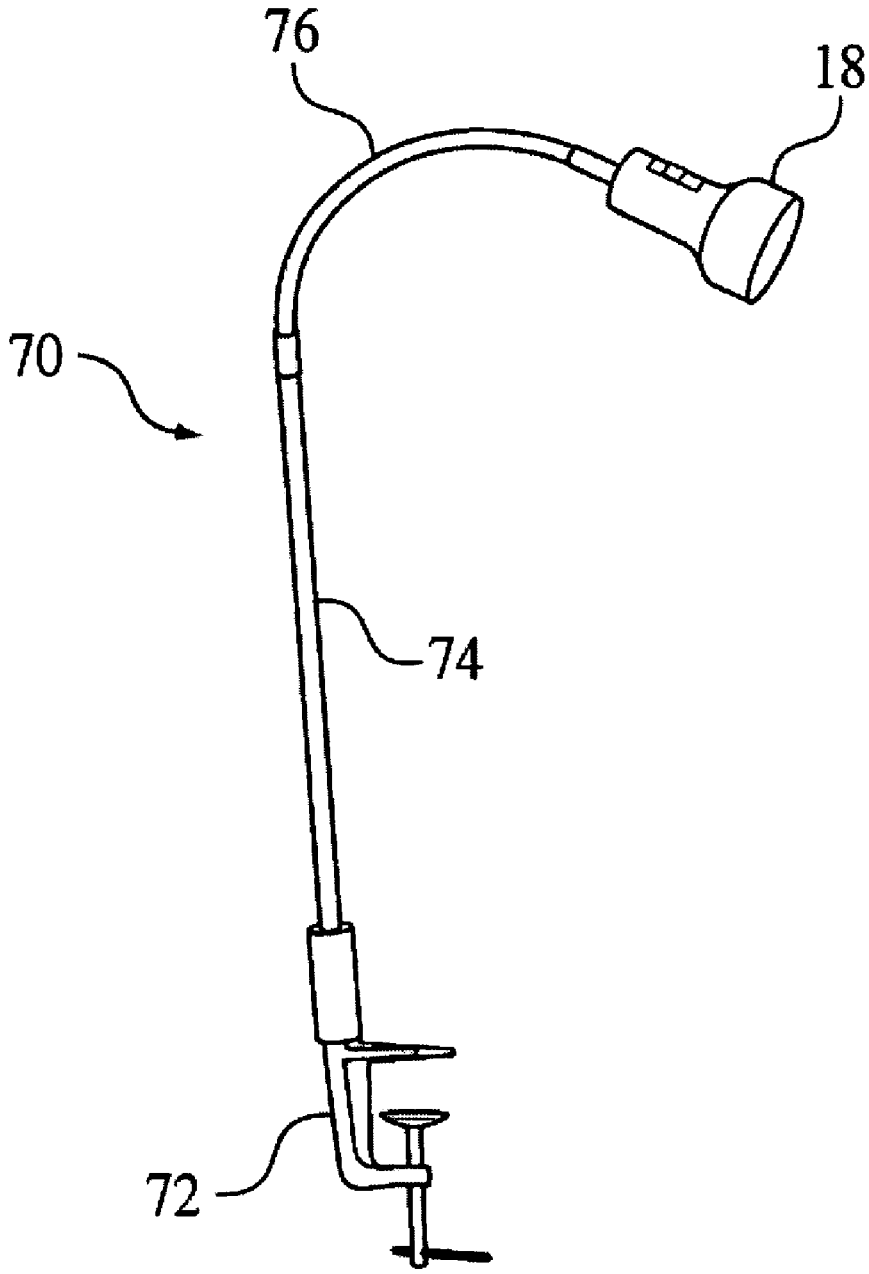

FIG. 12 shows a floor lamp 60 whose light source is the flashlight 18. The floor lamp 60 includes a base 62, adjustable upright rigid poles 64 (connected to each other) and flexible, bendable part 66 that positions the flashlight 18 into any one of a number of different orientations. FIG. 13 shows desk mounted lamp 70 with a clamp 72 at the base, an upright rigid pole 74 extending from the clamp and a flexible, bendable port 76 that positions the attached flashlight 18 into any of a number of different orientations. The embodiments of FIGS. 11-13 are preferably provided with indicator lights (visible externally) to illuminate upon commencement of battery recharging.

Figure 14:
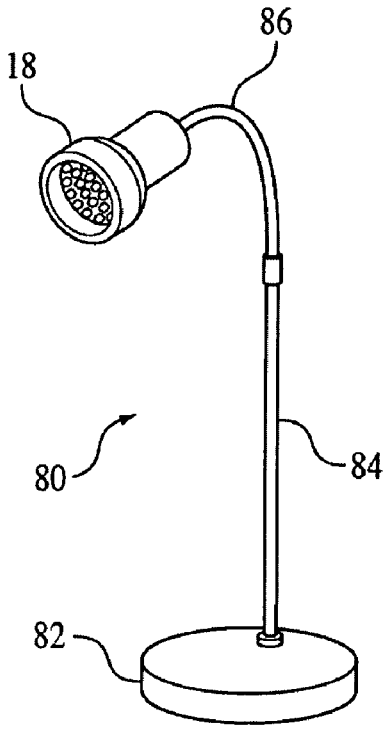
Figure 15:
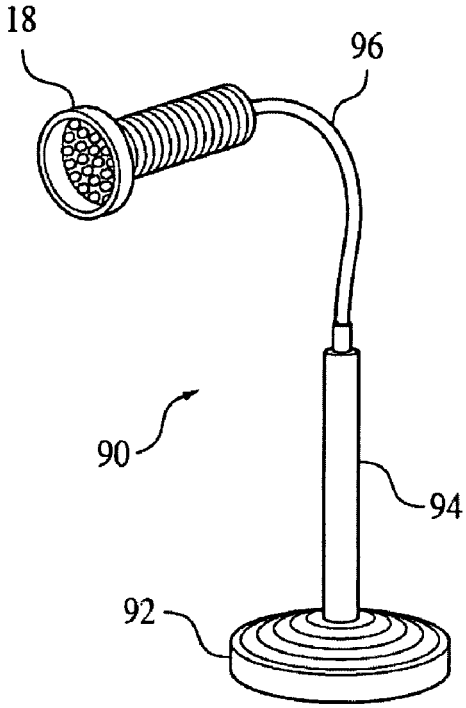

FIGS. 14 and 15 likewise show desk mounted lamps 80, 90, but without the clamp of FIG. 13. Instead, each is provided with its own base 82, 92, rigid pole 84, 94, flexible, bendable portion 86, 96 that may be bend into any one of a number of different orientations to position the flashlight 18 at its terminal end. They likewise may be provided with indicator lights that illuminate upon commencement of battery recharging.

Figure 16:
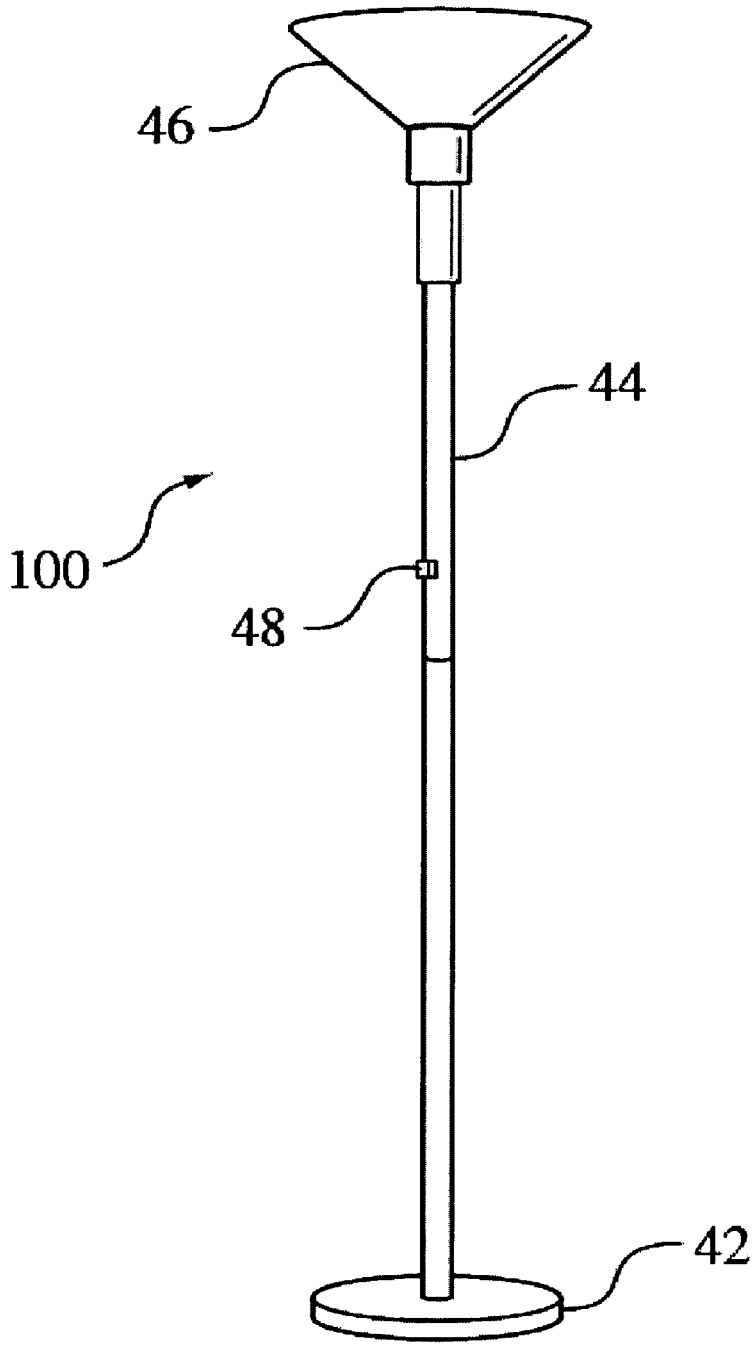
FIGS. 16-22 are isometric views of different styles of lamps in accordance with the invention that light automatically with power from their rechargeable batteries during a power outage.
Figure 17:
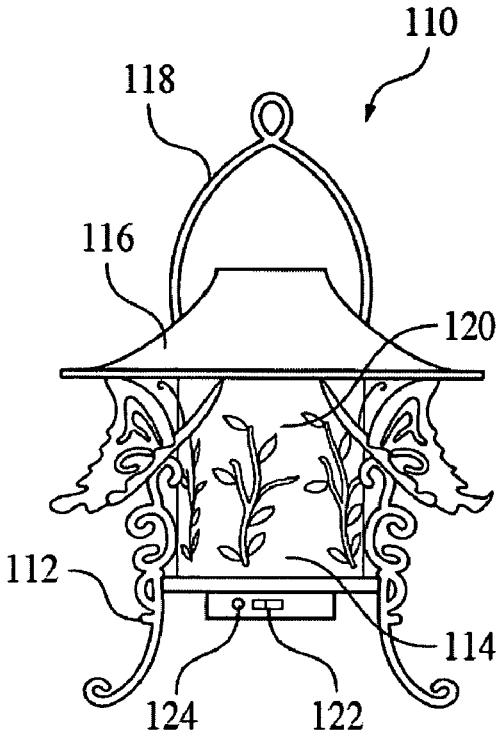
Figure 18:
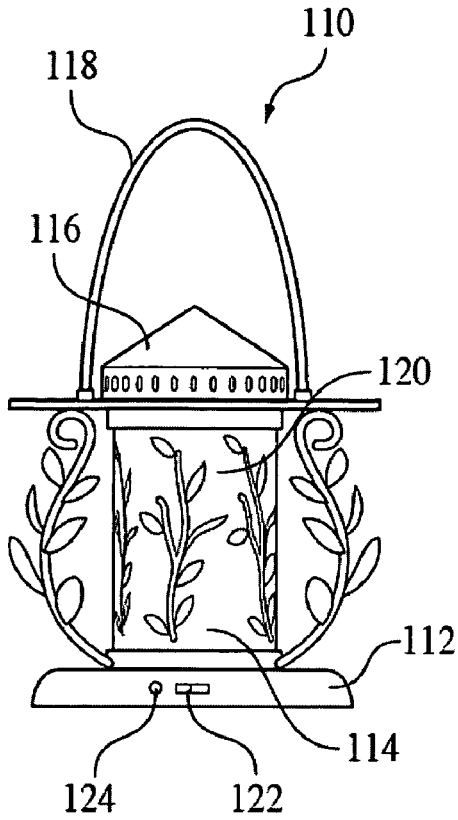
Figure 19:
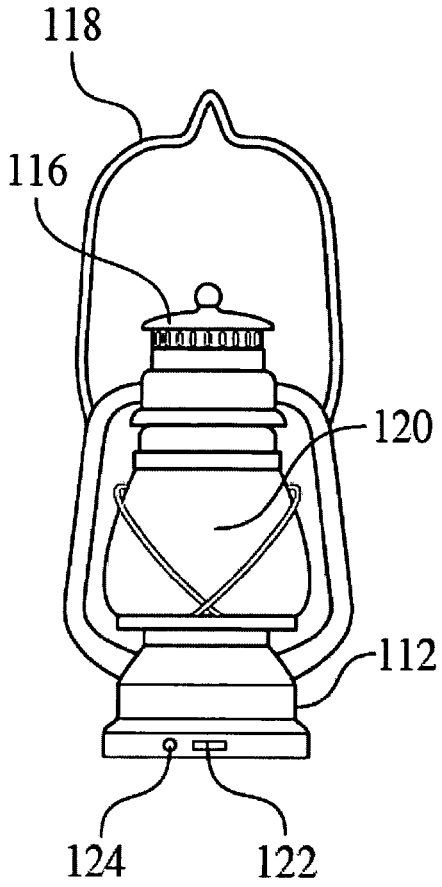
Figure 20:
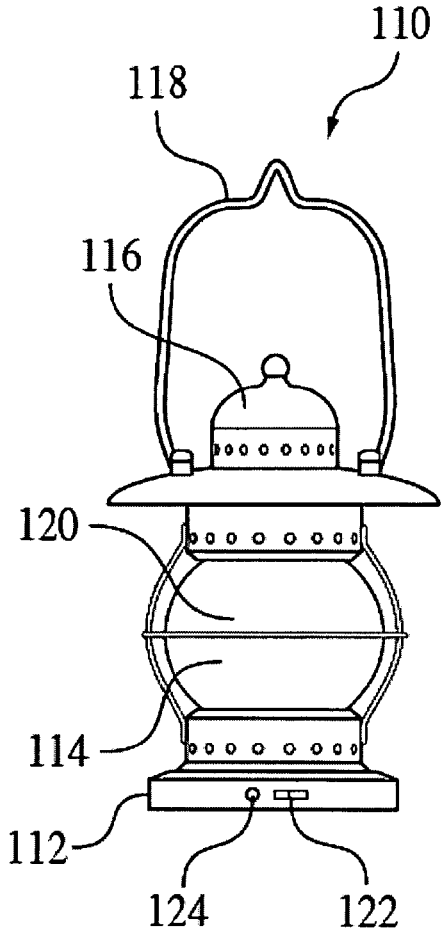

FIG. 16 shows a pole floor lamp 100 that resembles the floor lamps of FIGS. 9-11, except it lacks extension arms and the flashlight. It has a base 42, upstanding, telescoping pole 44, top translucent lamp shade 46 shading a light source (hidden by the shade) and a light switch 48. In this embodiment, the light source illuminates automatically upon detection of power outage, but can be turned on or off by the switch 48.

FIGS. 17-20 show lanterns 110 that operate in a manner analogous to that of the pole lamp of FIG. 16. Each lantern has a decorative base 112, a translucent shade 114, a decorative cap 116 and a handle 118. The translucent shade 114 encloses a light source 120, which illuminates automatically upon detection of a power outage, but can be turned on or off by the switch 122. During recharging of the batteries for powering the light source 120, an indicator light 124, such as one in the base 112, may be provided to illuminate to indicate commencement of charging of the batteries and thereby confirming there is a connection to a main power supply to power the light source 120 and recharge the batteries.

FIGS. 21-22 show a series of table lamps 130, whose shape or color of their bases and dimension of their shades may differ from each other. The shades shade a light source, which is powered by rechargeable batteries or direct to a main power supply. While the main power supply is available to power the lamp, circuitry within the lamp recharges the batteries as necessary. When there is a power outage, such is detected to automatically trigger illumination of the light source by the rechargeable batteries. Once power is restored to the main power supply, the main power supply powers the light source and recharges the batteries. Although not clearly visible, these table lamps may have indicators that illuminate upon commencement of battery recharging that are analogous to the indicator light 124 of FIGS. 17-20. Similarly, the pole floor lamp 100 of FIG. 16 has an indicator analogous to the indicator light 124 of FIGS. 17-20. If desired for all embodiments, the indicator light may turn off automatically after a time interval passes after commencement of the battery recharging or at the time the batteries become fully charged. The indicator light 124 may stay on all the time when the charging position on the switch is engaged.

In each of the embodiments, the light source that is illuminated by rechargeable batteries may have light emitting diodes with a reflector behind the light emitting diodes for reflecting light away from the reflector.

While the foregoing description and drawings represent the preferred embodiments of the present invention, it will be understood that various changes and modifications may be made without departing from the scope of the present invention.

What is claimed is:

1. An emergency preparedness lamp, comprising:

circuitry arranged to provide power to power a light source and to recharge one or more rechargeable batteries to a substantially fully charged state, the circuitry being configured to sense a power outage and to power the light source with said rechargeable batteries in response to sensing the power outage, the circuitry including transistors, resistors and diodes, the light source including one or more light emitting diodes and a reflector positioned to reflect back light striking the reflector from said light emitting diodes in a direction away from the reflector;

a first housing that contains at least part of the circuitry, the first housing having a base and elevating the light source above the base as the base is stationary on an external surface; and a second housing containing the light source and said rechargeable batteries, the second housing having a first position attached to the first housing in which said rechargeable batteries are rechargeable by the circuitry and a second position detached from the first housing in which said rechargeable batteries provide power to the light source.

2. The emergency preparedness lamp of claim 1, further comprising:

an indicator powered by the circuitry to make an indication upon commencement of the recharge of said rechargeable batteries with the power from the circuitry.

3. The emergency preparedness lamp of claim 1, further comprising:

a flashlight having the light source, the flashlight constituting the second housing; and an extension arm that projects from the first housing and holds the flashlight in position, the flashlight being detachable from the extension arm.

4. The emergency preparedness lamp of claim 1, further comprising:

a flashlight that constitutes the second housing, an extension aim that projects from the first housing and holds the flashlight in position, the flashlight being detachable from the extension arm, and a further light source arranged in connection with the first housing, the circuitry being configured to power the further light source as required.

5. The emergency preparedness lamp of claim 3, wherein said light emitting diodes are arranged to illuminate in response to the detection of the power outage, the flashlight having a switch manually movable between operative and inoperative positions, said light emitting diodes becoming illuminated in response to the switch entering the operative position and turning off in response to the switch entering the inoperative position, the reflector being arranged behind said light emitting diodes so that, as said light emitting diodes are turned on to generate light, the reflector reflects the light striking the reflector outwardly away from the flashlight.

6. The emergency preparedness lamp of claim 4, wherein said light emitting diodes are arranged to illuminate in response to the detection of the power outage, the flashlight having a switch manually movable between operative and inoperative positions, said light emitting diodes becoming illuminated in response to the switch entering the operative position and turning off in response to the switch entering the inoperative position, the reflector being arranged behind said light emitting diodes so that, as said light emitting diodes are turned on to generate light, the reflector reflects the light striking the reflector outwardly away from the flashlight.

7. The emergency preparedness lamp of claim 4, wherein the flashlight is attached to the extension arm via engaging mechanical and electrical connectors, the extension arm having one of the mechanical connectors and one of the electrical connectors, the flashlight having another of the mechanical connectors and another of the electrical connectors.

8. The emergency preparedness lamp of claim 4, wherein said arm extension is constructed of bendable and flexible materials that allow said arm extension to bend into a bent position under manual pressure into any one of a plurality of different relative orientations and remain in the bent position unless and until repositioned into a different orientation under manual pressure.

9. The emergency preparedness lamp of claim 1, further comprising a lamp frame that supports the first housing, the lamp frame being selected from a group consisting of pole lamp frames, floor lamp frames, desk lamp frames and lantern frames.

10. The emergency preparedness lamp of claim 1, further comprising a coupling arrangement that removably couples the first housing to the second housing, the coupling arrangement comprising a pair of mating mechanical connectors, one arranged in connection with the first housing and another arranged in connection with the second housing.

11. The emergency preparedness lamp of claim 1, wherein said first housing includes a light source coupled to said circuitry and that is powered either by said circuitry when said second housing is in the first position or by said rechargeable batteries during a power outage.

12. An emergency preparedness lamp, comprising:

circuitry arranged to provide power to power a light source and to recharge one or more rechargeable batteries to a substantially fully charged state, said circuitry being configured to sense a power outage and to power said light source with said rechargeable batteries in response to sensing the power outage, said circuitry including transistors, resistors and diodes, said light source including one or more light emitting diodes and a reflector positioned to reflect back light striking said reflector from said light emitting diodes in a direction away from said reflector;

a housing that contains at least part of the circuitry, said housing having a base and elevating said light source above the base as the base is stationary on an external surface;

a flashlight having said light source; and an extension arm that projects from said housing and holds said flashlight in position, said flashlight being detachable from said extension arm.

13. The emergency preparedness lamp of claim 12, further comprising:

an indicator powered by said circuitry to make an indication upon commencement of the recharge of said rechargeable batteries with the power from said circuitry.

14. The emergency preparedness lamp of claim 12, wherein said light emitting diodes are arranged to illuminate in response to the detection of the power outage, said flashlight having a switch manually movable between operative and inoperative positions, said light emitting diodes becoming illuminated in response to the switch entering the operative position and turning off in response to the switch entering the inoperative position, said reflector being arranged behind said light emitting diodes so that, as said light emitting unit is turned on to generate light, said reflector reflects the light striking said reflector outwardly away from said flashlight.

15. The emergency preparedness lamp of claim 12, further comprising a lamp frame that supports said first housing, said lamp frame being selected from a group consisting of pole lamp frames, floor lamp frames, desk lamp frames and lantern frames.

16. An emergency preparedness lamp, comprising:

circuitry arranged to provide power to power a light source and to recharge one or more rechargeable batteries to a substantially fully charged state, said circuitry being configured to sense a power outage and to power said light source with said rechargeable batteries in response to sensing the power outage, said circuitry including transistors, resistors and diodes, said light source including one or more light emitting diodes and a reflector positioned to reflect back light striking said reflector from said light emitting diodes in a direction away from said reflector;

a housing that contains at least part of said circuitry, said housing having a base and elevating said light source above the base as the base is stationary on an external surface;

a flashlight;

an extension arm that projects from said housing and holds said flashlight in position, said flashlight being detachable from said extension arm, and a further light source, said circuitry being configured to power said further light source as required.

17. The emergency preparedness lamp of claim 16, wherein said light emitting diodes are arranged to illuminate in response to the detection of the power outage, said flashlight having a switch manually movable between operative and inoperative positions, said light emitting diodes becoming illuminated in response to the switch entering the operative position and turning off in response to the switch entering the inoperative position, said reflector being arranged behind said light emitting diodes so that, as said light emitting diodes are turned on to generate light, said reflector reflects the light striking said reflector outwardly away from said flashlight.

18. The emergency preparedness lamp of claim 16, wherein said flashlight is attached to said extension arm via engaging mechanical and electrical connectors, said extension arm having one of the mechanical connectors and one of the electrical connectors, said flashlight having another of the mechanical connectors and another of the electrical connectors.

19. The emergency preparedness lamp of claim 16, wherein said arm extension is constructed of bendable and flexible materials that allow said arm extension to bend into a bent position under manual pressure into any one of a plurality of different relative orientations and remain in the bent position unless and until repositioned into a different orientation under manual pressure.

* * * * *